US006227076B1

(12) United States Patent
Murray

(10) Patent No.: US 6,227,076 B1
(45) Date of Patent: May 8, 2001

(54) SHAFT WRENCH

(76) Inventor: Jack E. Murray, 317 Norwood Dr., Bristol, TN (US) 37620

( * ) Notice: Subject to any disclaimer, the term of this patent is extended or adjusted under 35 U.S.C. 154(b) by 0 days.

(21) Appl. No.: 09/498,777

(22) Filed: Feb. 5, 2000

Related U.S. Application Data

(63) Continuation-in-part of application No. 09/272,984, filed on Mar. 20, 1999.

(51) Int. Cl.[7] ..... B25B 13/00
(52) U.S. Cl. ..... 81/58.2; 81/90.1
(58) Field of Search ..... 81/57.33, 58.2, 81/60, 90.1, 90.3

(56) References Cited

U.S. PATENT DOCUMENTS 3,906,822 * 9/1975 Hertelendy et al. ..... 81/90.1
4,644,830 * 2/1987 Bailey et al. ..... 81/58.2
5,282,830 * 2/1994 Reynolds ..... 81/58.2

* cited by examiner

*Primary Examiner*—James G. Smith
*Assistant Examiner*—David B. Thomas

(57) ABSTRACT

Wrench structure for placement on over a generally circular workpiece in either a lateral or an axial direction and having a drive head with a cavity formed by a base member and an access cap, a bore formed thru the base member and cap around a rotational axis for accommodating the workpiece, a plurality of gripping jaws pivotally mounted within the cavity and arranged in a substantially circular pattern around the rotational axis and having gripping faces extending at least partially into the bore, each face being knurled and formed substantially on a radius line which makes an angle from about 6.0° to about 25° with a longitudinal axis of the jaw at a lateral midpoint of the face, and each face thereby having a neutral contact portion and a working contact portion.

18 Claims, 7 Drawing Sheets

SHAFT WRENCH

This application is a continuation-in-part of Applicant's pending and allowed Ser. No. 09/272,984 of same title filed Mar. 20, 1999.

BACKGROUND OF THE INVENTION

1. Field of the Invention

This invention concerns a wrench particularly adapted for torquing round shafts or nuts or the like structures, and especially those structures such as the inner tie rod threaded or pressed on nuts of automobiles, which nuts on structures which are in confined locations and may not be easily accessible laterally, or nuts on structures which are connected at both ends to other structure and thereby not readily accessible for power rotating.

2. Prior Art

Heretofore, specialty type wrenches have been developed for torquing nuts, pipes and other variously shaped structures as shown in U.S. Pat. Nos. 2,700,315; 5,282,830; 3,783,703; 5,553,520; 3,906,822; 2,989,880; 4,676,125; 3,664,213; 3,527,327; 2,992,735; 4,724,730; 2,659,257 and Ger. 3,106,510.

While these wrenches may be adequate to torque the items for which they were designed, they cannot meet the non-slip requirements for torquing such items as automotive rack and pinion inner tie rod assemblies which requires considerable torque in a confined space, and which invites severe knuckle or other injury when the torquing tool or wrench slips.

OBJECTS OF THE INVENTION

Objects, therefore, of the present invention are: to provide a heavy-duty, non-slip torque wrench, i.e., a drive head with or without handle means, which head has automatic adjustability to accommodate a range of work item diameters, such as from about 1.4 to about 1.6 inches, wherein the wrench is comprised of highly accurately machined or cast steel, preferably stainless steel components and is exceptionally safe to use; and to provide such a wrench with structure which is adaptable for mounting onto rotative power equipment such as lathes, drill presses or milling machines for being torque rotated thereby for loosening or tightening exceptionally difficult threaded on or pressed on workpieces.

SUMMARY OF THE INVENTION

The above and further objects hereinafter becoming evident have been attained in accordance with the present invention thru the discovery of wrench structure which is defined in its broad sense as a drive head having a generally disc-shaped body and an access cap forming a cavity means, each of said body and cap being formed with a workpiece receiving bore and, in one special embodiment, is provided with a lateral slot for allowing a workpiece shaft portion or nut or the like to slide laterally into the bore, and further having a plurality of jaw members pivotally mounted in the cavity means in a substantially circular pattern around said bore wherein the jaw members are positioned preferably but not essentially in a symmetrical manner around said bore, each jaw member having a gripping face extending at least partially into the bore, wherein each jaw member has a pivot segment as measured along its longitudinal axis to its intersection with the lateral midpoint of said gripping face, wherein each said face is formed substantially on a radius line which makes an angle of from about 9.0° to about 20°, most preferably from about 11.5° to about 14.5° with said longitudinal axis at said midpoint, thereby to provide each said face with a variable length neutral contact portion and a variable length working contact portion.

In certain preferred embodiments:

(a) the jaw members are formed with integral stub shafts which are pivotally mounted in bearing sockets in the body and access cap;

(b) spring means are provided on the head to bias the jaw members toward their gripping positions;

(c) first shoulder means is provided on a radially outer portion of each said jaw member, and a hand operable, generally sleeve-shaped actuator means is rotatably mounted on said body radially outwardly of said cavity means and is provided with second shoulder means engageable with said first shoulder means upon rotation of said actuator means to thereby selectively pivot said jaw members toward or away from engagement with a workpiece positioned in said bore; and (d) wherein the ratio of the length of said radius line to the length of said pivot segment, as measured in the same units, preferably ranges from about 2 to about 7, and most preferably from about 2.5 to about 3.5.

BRIEF DESCRIPTION OF THE DRAWINGS

The invention will be further understood from the following drawings and descriptions of certain preferred embodiments wherein the figures are not necessarily drawn to scale and wherein some structures are enlarged and/or broken away for clarity, wherein.

DETAILED DESCRIPTION OF PREFERRED EMBODIMENTS

Figure 3:
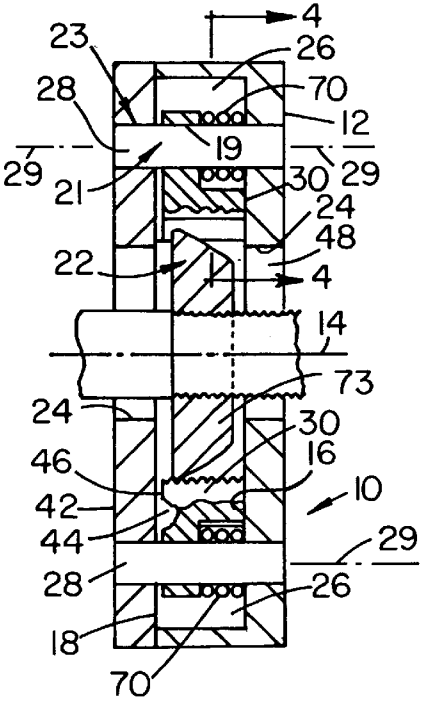
FIG. 3 is a cross-sectional view taken along line 3—3 of FIG. 1 in the direction of the arrows.
Figure 1:
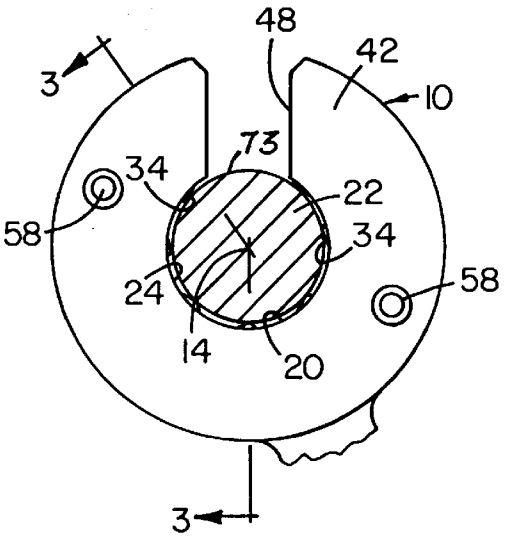
FIG. 1 is a top view of one embodiment of the present drive head with the jaw gripping faces enlarged for clarity and shown in operating contact with a workpiece shown in cross-section.
Figure 2:
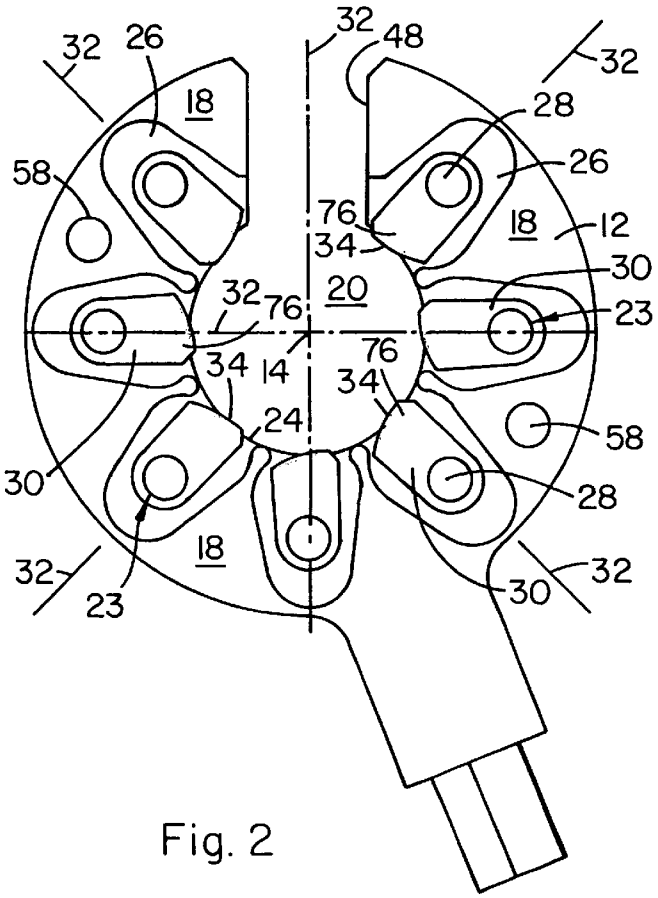
FIG. 2 is a view as in FIG. 1 with the top cap removed to show the cavity means or recesses and the pivotally mounted jaw members.
Figure 15:
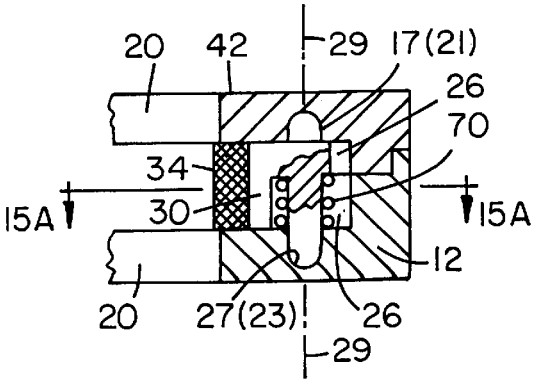
FIG. 15 is a side view of the jaw member taken in the direction of line 15—15 in FIG. 13 in the direction of the arrows.
Figure 15A:
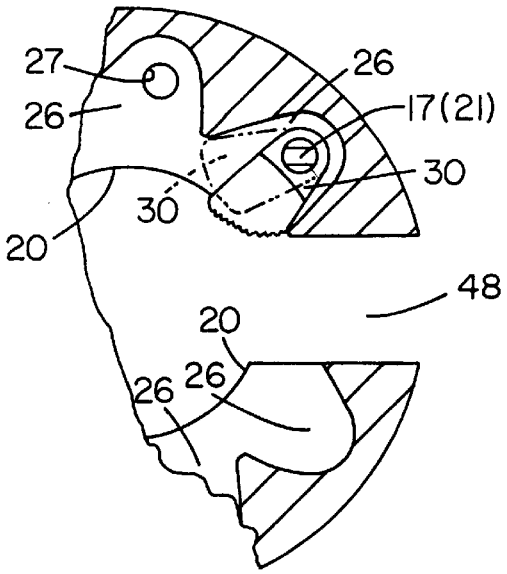
FIG. 15A is a cross-sectional view taken along line 15A—15A of FIG. 15 in the direction of the arrows.

Referring to the drawings and with particular reference to the claims hereof, the present wrench structure, preferably of hardened steel components, preferably stainless steel, and either machined or cast, is defined in its broad sense as a drive head 10 having generally circular shaped body means 12 having a rotational axis 14 and formed to provide a base or bottom side 16 and a top or access side 18. A top cap means 42 is adapted to be secured to 12 to provide cavity or recess means 26. A substantially circular bore means 20 is formed around axis 14 in said body means and cap means for accommodating a substantially circular workpiece such as 22, said bore means being defined by inner peripheral wall means 24 on both 12 and 42. A plurality of recesses or cavity means 26 are formed into access side 18 in a substantially circular pattern around rotational axis 14 and which open generally radially into said bore means 20. In each of the recesses, body means 12 is provided with a first pivot means generally designated 23 and comprising structure such as a jaw mounting dowel 28 (FIG. 3), a shaft bearing socket 27 (FIG. 15) or a bearing cavity 25 (FIG. 16) axially oriented and providing a jaw pivot axis 29, all of which axes 29 are positioned preferably equidistantly from said rotational axis 14. A jaw member 30 having a second pivot means 21 such as a bearing bore 19 (FIG. 3), stub shafts 17 (FIG. 15), or a quasi shaft segment 15 (FIG. 16), and having a longitudinal axis 32 is pivotally mounted on each said first pivot means and is formed with a gripping face 34 oriented generally toward rotational axis 14 and at least partially extends into bore means 20. Each jaw member has a pivot segment 35 as measured along said longitudinal axis and each gripping face is formed substantially on a radius line 36 extending from an arc 47 center point 45 and preferably makes an angle alpha of from about 9.0° to about 20° at its intersection with said longitudinal axis 32 at the midpoint 43 of said gripping face.

The gripping face 34 has a neutral contact portion dimensionally arbitrarily shown as 38, and a working contact portion dimensionally arbitrarily shown as 40, each of varying lengths depending on the workpiece diameter and the position and lengths of said longitudinal axis, said radius line 36, and said pivot point 29, cap means 42 on said access side of said body means and covering top portions 44 of said recesses and 46 of said jaw members, and access slot means 48 formed generally radially thru said body means and cap means and entering into said bore means 20 for allowing said drive head to be laterally moved onto said workpiece 22.

Figure 11:
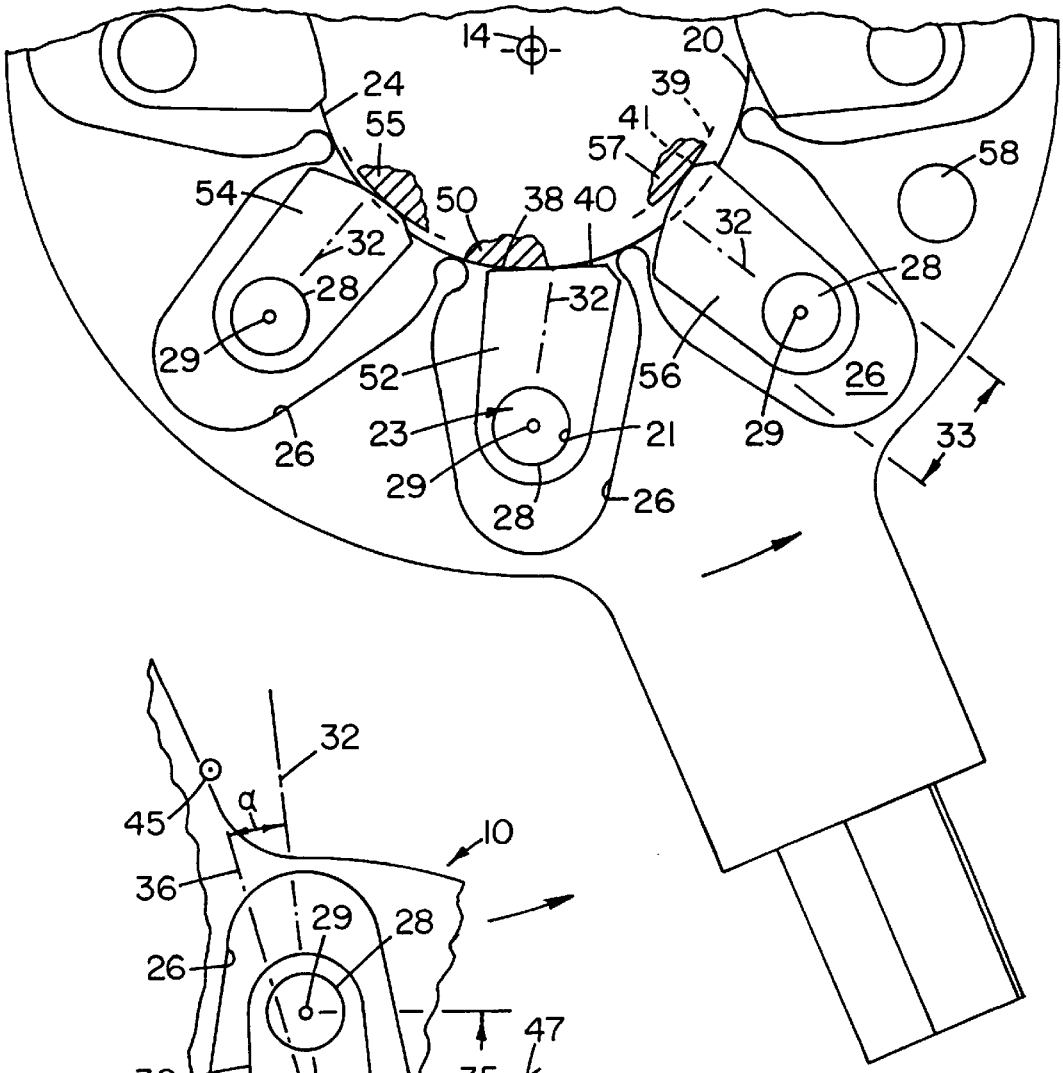
FIG. 11 is an enlarged, partial view as in FIG. 2 showing three jaw members in different positions, i.e., near minimum, median and near maximum radial translation positions of the gripping face as each pivots from its neutral position to its full radial extension.
Figure 10:
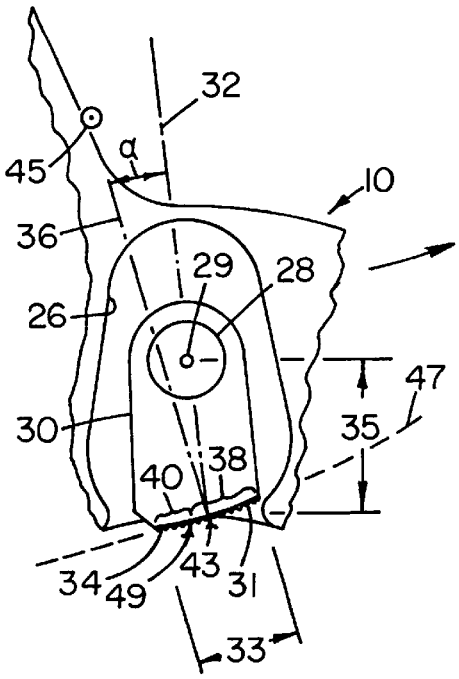
FIG. 10 is an enlarged top view of a jaw member showing important dimensional and angular relationships between certain ones of its structural portions.

It is noted that any number of jaw members may be provided, however, from three to eight are preferred. The longitudinal axes 32 of the jaw members pass thru the lateral midpoints 43 of the gripping faces and the jaw pivot axes 29. In the exemplary arrangement as shown in FIGS. 10 and 11 with respect to a workpiece 57, axes 32 are offset to one side of the workpiece contact points 49, which points dimensionally divide each face 34 at approximately a two to one ratio of neutral portion 38 to working portion 40. This ratio will change if the diameter of the workpiece changes and its surface consequently comes into initial gripping contact with the jaw faces at a different point thereon.

In one exemplary embodiment, the circular inner peripheral wall 24 has a diameter of three inches across the rotational axis 14, each radius line length 36 is 1.5125 inches including knurl height on each gripping face, each angle alpha is 11.5°, each pivot segment 35 length as measured from pivot point 29 to the intersection of the longitudinal axis 32 with face 34, is 0.5 inches excluding the knurl height, the total width 33 of each gripping face 34 is 0.44 inches, the maximum radial translation 37 of each face 34 is 0.064 inches, and each knurl height is 0.0125 inches. By increasing the above dimensions in a selective manner, the workpiece diameter can be increased accordingly and also the operable ranges of diameters which the head can handle. A very useful set of the above dimensions accommodates a workpiece diameter range of from about 1.4 to about 1.6 inches.

It is noted that the preferred knurl comprising spikes 31 as shown in FIG. 10 is designed to give a secure grip on workpieces which are not necessarily smooth or clean, e.g., such as the shafts, journals and other parts of well used rack and pinion inner tie rod assemblies. This preferred knurl has a spike density of from about 350 to about 560 spikes per square inch of gripping face, and a spike height of from about 0.005 to about 0.030 in., with from about 0.008 to about 0.02 in., being most preferred.

Referring further to FIG. 11 wherein three different operating scenarios are given, neutral portion 38 and working portion 40 of the jaw face overlap in the sense that where a workpiece 50 has a diameter just slightly less than the bore 20, then neutral portion 38 of jaw member 52 will contact the workpiece first and then the face will ramp up toward its working portion 40 as the head is rotated counterclockwise in FIG. 11 and becomes tightened against the workpiece. Where the workpiece diameter is reduced as shown by dotted line 39, the initial contact with working portion 40 will be translated further along the face toward the maximum extension shown by dotted line 41 in FIG. 11.

In FIG. 11, jaw member 52 is shown in a near minimum radial translation position of the gripping face and engaging workpiece 50, jaw member 54 is shown in a median radial translation position and engaging workpiece 55, and jaw member 56 is shown in a near maximum radial translation position and engaging workpiece 57. It is thus seen that the present structural dimensioning, configuration and relationships render the present wrench markedly functionally improved over prior wrenches in preventing slippage on the workpiece, which prevention arises from the exceptionally high clamping forces of the jaw faces against the workpiece developed generally along said longitudinal axes thru very small rotation of the wrench head.

In a preferred embodiment, the ratio of the diameter of bore 20 to the diameter of workpiece 22 which the present wrench can accommodate ranges from about 1.0 to about 1.2, and most preferably from about 1.0 to about 1.15.

In one preferred embodiment, the body 12 is provided with heavy positioning pins 58 which extend outwardly from either or both sides of the head and are adapted to fit into recesses in a rotative portion of a power apparatus such as a lathe head whereby large torque's can be applied to the wrench head.

Figure 7:
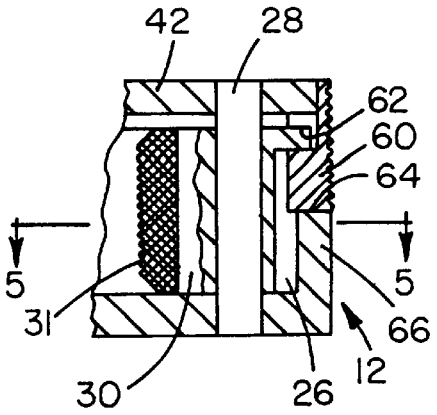
FIG. 7 is a cross-sectional view taken along line 7—7 of FIG. 5 in the direction of the arrows and with the top cap in place and showing workpiece lead-in chamfers on the axial edges of the jaw members.
Figure 6:
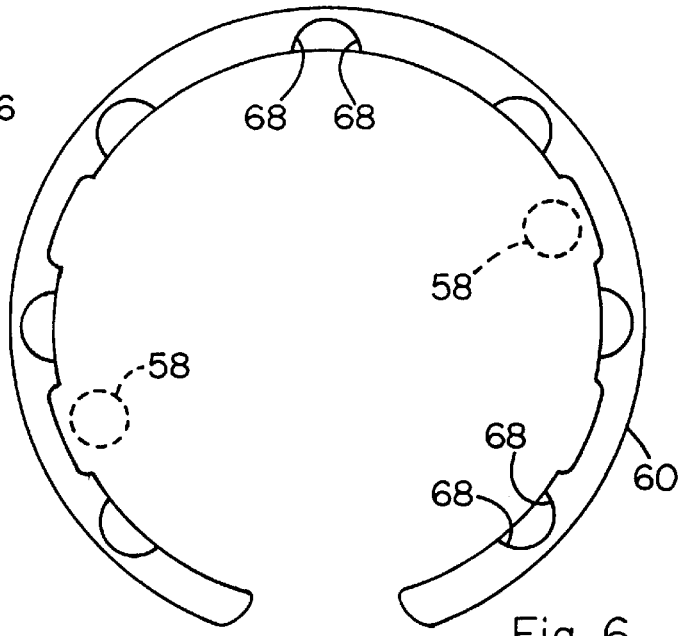
FIG. 6 is a top view of the actuator means of FIG. 5.
Figure 4:
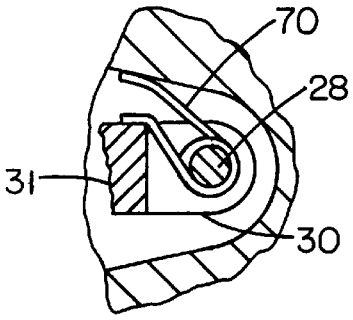
FIG. 4 is a cross-sectional view of a portion of the head taken along line 4—4 of FIG. 3 in the direction of the arrows.
Figure 5:
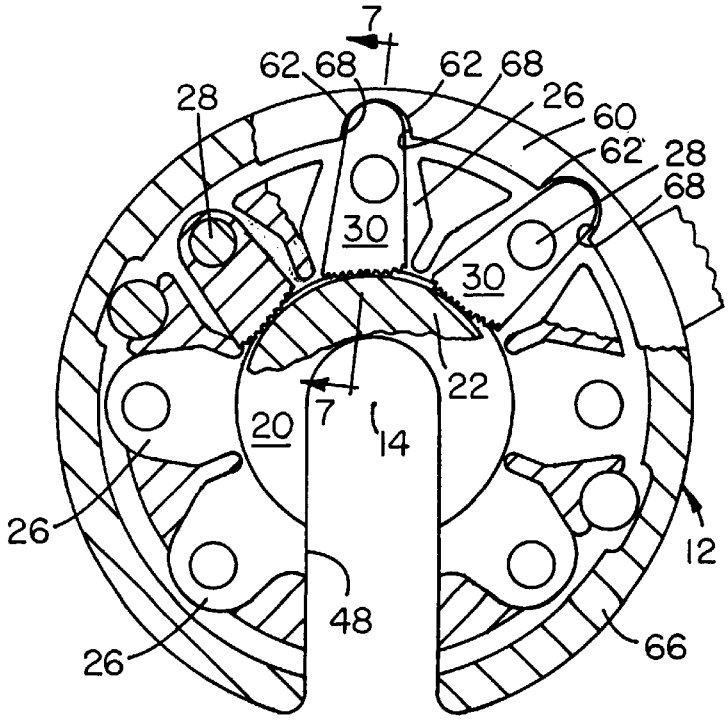
FIG. 5 is a view as in FIG. 2 of another embodiment of the drive head which utilizes a hand operated actuator means for manually pivoting a modified form of the jaw members to their operative positions as partially tightened against a workpiece, wherein portions of the actuator means and body means are shown in cross-section at the level shown as 5—5 in FIG. 7 and some of the jaw members removed for clarity.
Figure 8:
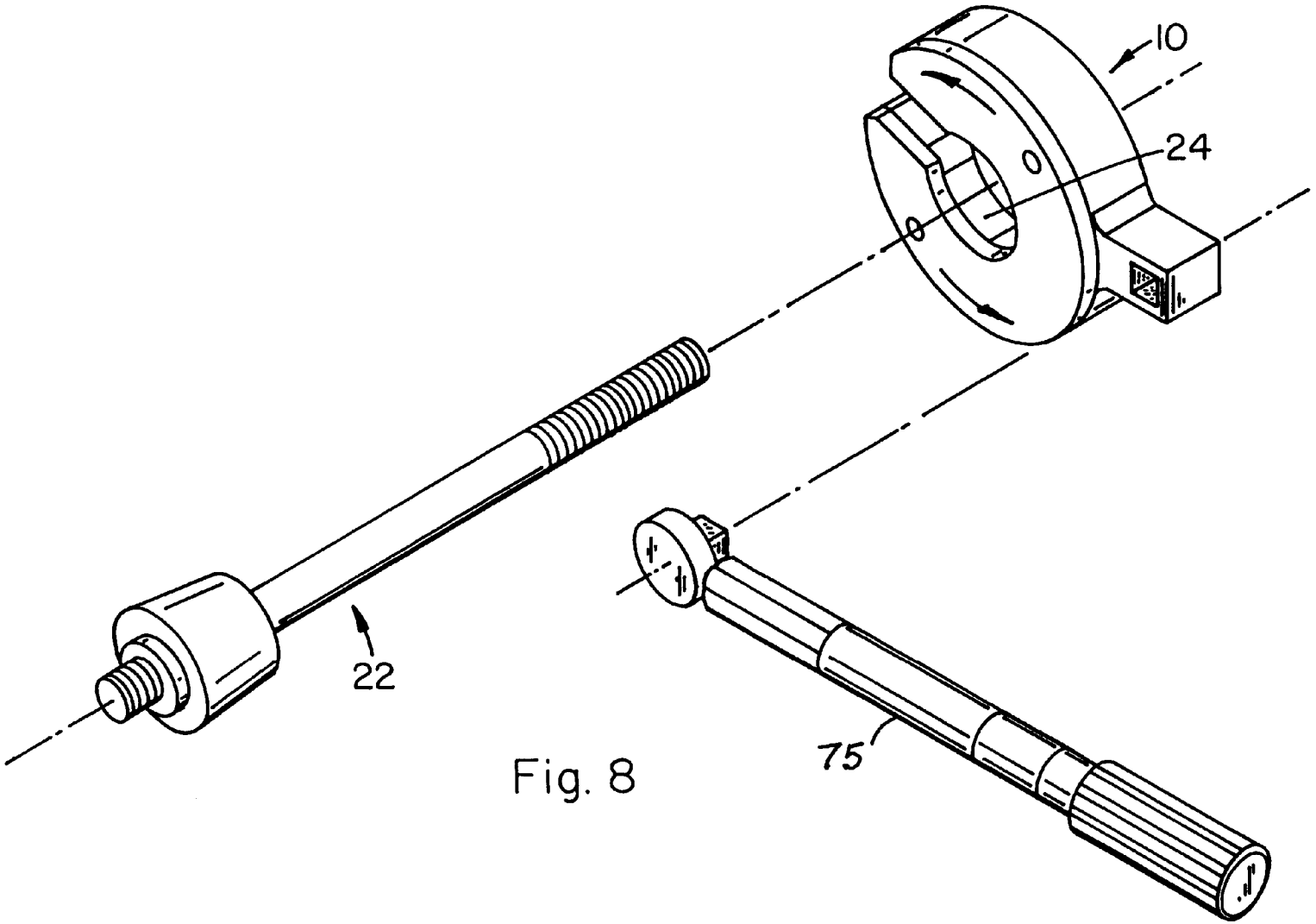
FIG. 8 is an isometric assembly view of the FIG. 1 embodiment of the present wrench head, wherein a square hole handle socket is provided on the head.
Figure 9:
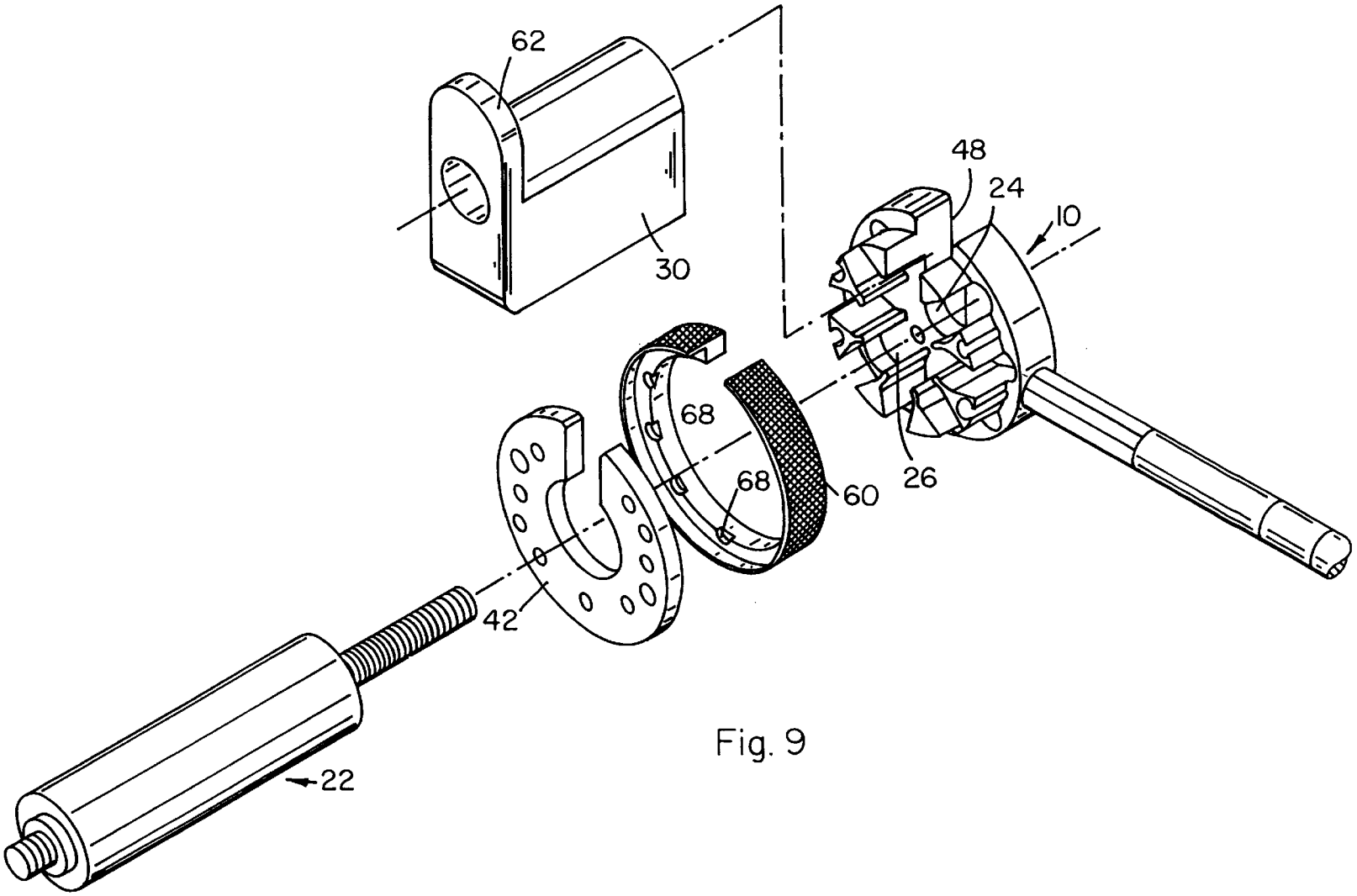
FIG. 9 is an isometric assembly view of the FIG. 5 embodiment of the present wrench.

Referring to FIGS. 5–7 wherein a hand rotatable actuator ring 60 is provided to assist the jaw members in making initial contact with the workpiece, a set of first shoulder means 62 is provided on a radially outer portion of each said jaw member 30, and the sleeve-shaped actuator ring is rotatably mounted on the top surface 64 of peripheral side 66 of said body 12, which side lies radially outwardly of recesses 26. The ring is provided with a set of second shoulder means 68 engageable with one set of said first shoulder means 62 upon rotation of said actuator means to thereby selectively pivot said jaw members toward or away from engagement with a workpiece such as 22 positioned in said bore 20. This embodiment is not shown as employing a biasing spring such as 70 which is preferably, but not necessarily used with the jaw members of FIGS. 1–4. However, the provision of such a spring in combination with ring 60 makes an excellent combination in that the jaw members can be positively retracted out of the way of a workpiece being entered into bore 20, and then, by simply releasing the ring the jaw members are forced into positive engagement with the workpiece with sufficient frictional contact to begin the ramping up of the gripping faces on the workpiece.

Figure 12:
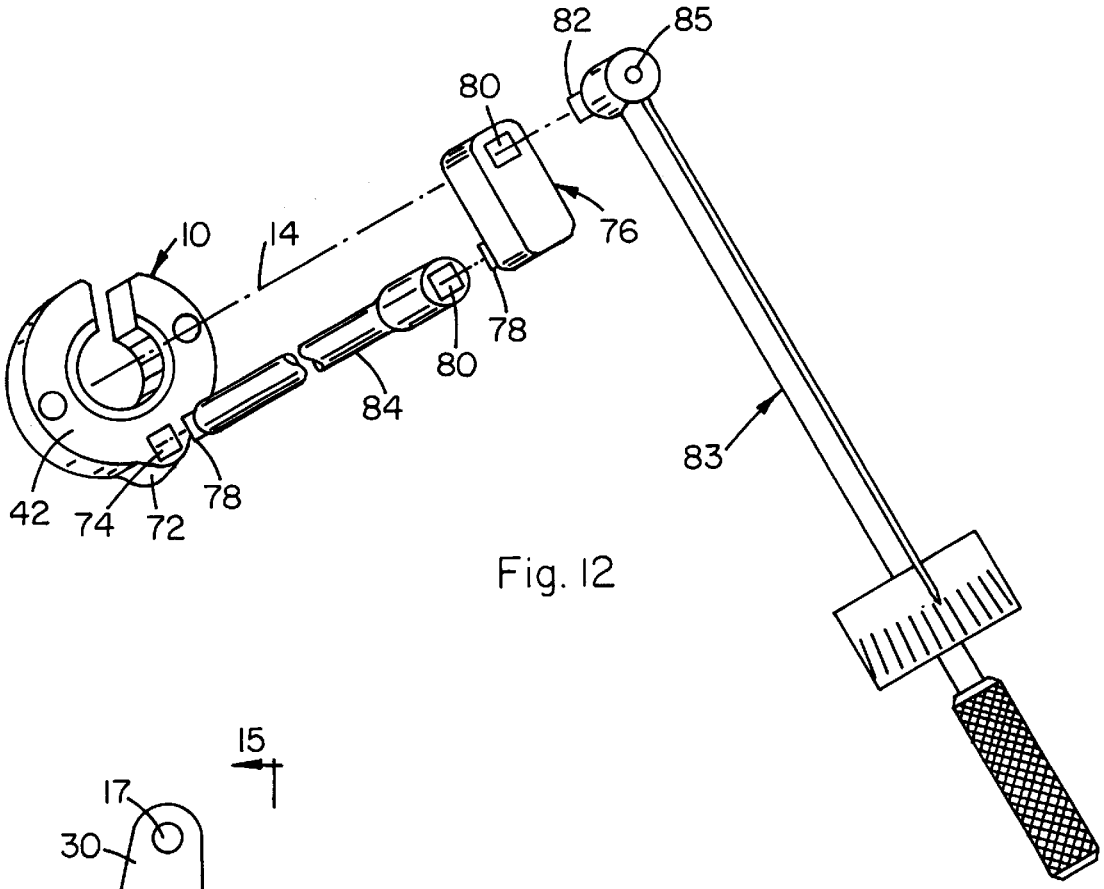
FIG. 12 is an isometric view of a variation in structure of the present drive head and torque wrench adapter structure.
Figure 13:
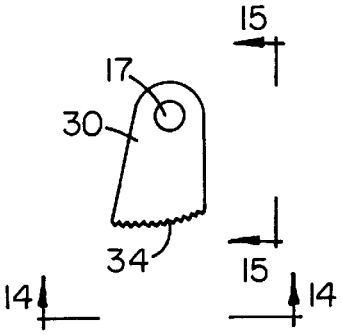
FIG. 13 is a top view of a variation in construction of the jaw member.
Figure 14:
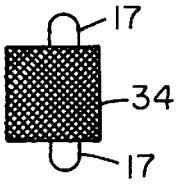
FIG. 14 is an end view of the jaw member taken in the direction of line 14—14 in FIG. 13 in the direction of the arrows.

Referring to FIG. 12, the drive head 10 is provided with a radially extending torque adapter prominence 72 thru which a first key element such as square hole 74 is provided. A crank arm 76 is provided with a mating second key element such as square shaft segment 78 and a socket 80 for receiving a mating key segment 82 of a torque axis 85. An extension shaft 84 may be provided and having equivalent key segment 78 and socket 80. The torque axis 85 of socket 80 on arm 76 is coextensive with rotational axis 14 such that a direct torque reading can be taken from wrench 83. Any shape of key elements may be employed and said first and second elements can be reversed.

Figure 18:
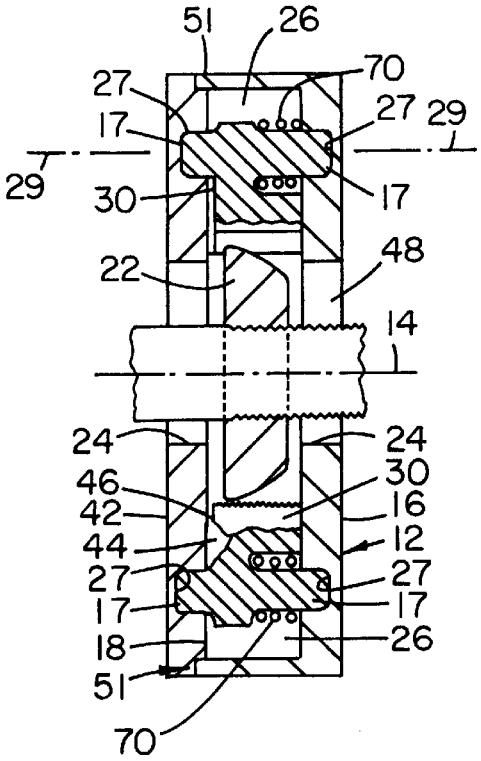
FIG. 18 is a view as in FIG. 3 but showing use of the monolithically formed jaw member and its pivotally mounted stub shafts.

Referring to FIGS. 13, 14, 15 and 18 wherein structures which are equivalent in function and structure to those previously described may be numbered the same, jaw member 30 is preferably manufactured as a monolithic structure having integral stub shafts 17 which are rotatably mounted in shaft bearing sockets such as 27 provided in each of the body means 12 and cap means 42. Also shown in FIG. 18 is a nesting shoulder structure generally designated 51 which preferably is provided substantially around the entire periphery of the drive head and thereby provides greatly enhanced lateral strength to the joint between body 12 and top cap 42.

Figure 16:
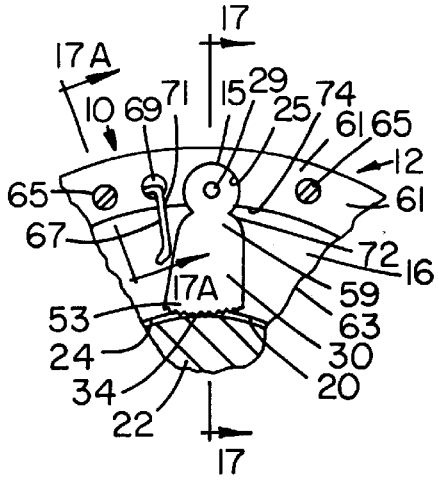
FIG. 16 is a top view of a variation in the pivotal mounting structure for the jaw members and body means, where the top cap means which is equivalent to 42 in FIG. 3 has been removed for clarity.
Figure 17:
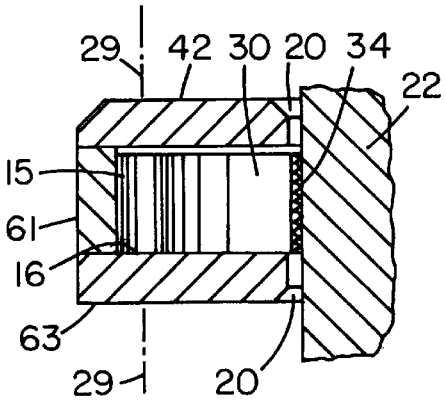
FIG. 17 is a cross-sectional view taken along line 17—17 in FIG. 16 but with the jaw member shown in elevation and with said top cap means shown in operating position.

Referring to FIGS. 16 and 17, a highly simplified drive head structure is shown wherein jaw member 30 is also a monolithic structure having a forward end 53 and a rearward end 59. End 59 is formed with a quasi shaft segment 15 of any convenient length but, preferably, about the same length as the jaw member is high. This segment is pivotally mounted in a bearing cavity 25 formed down thru a ring member 61 constituting a portion of body 12 and which ring member may be in the form of a complete circle or slotted as in FIGS. 1 and 2 at 48. In this embodiment of FIGS. 16 and 17, the body 12 may constitute a bottom or base plate 63 and the separate ring member 61.

Figure 17A:
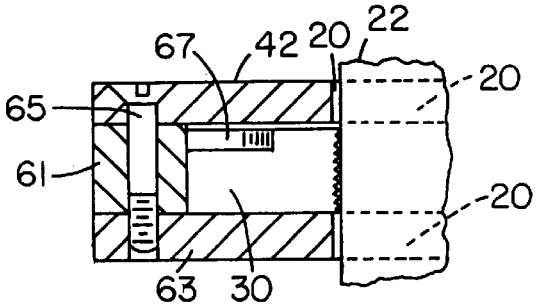
FIG. 17A is a cross-sectional view taken along line 17A—17A of FIG. 16 in the direction of the arrows, but with cap 42 in place.

The bearing cavities 25 are easily formed down thru or partially thru the ring member by drilling or casting, and the assembly of these monolithic jaw members on the ring simply requires segments 15 to be slid down into these bearing cavities. Leaf spring 67 is then slid down into hole 69 and slot 71 to provide a continuous small force against 30 to urge it in a counterclockwise pivotal direction as viewed in FIG. 16 such as to always present at least a portion of face 34 within bore 20. Shoulder 72 on member 30 and shoulder 74 on ring member 61 by way of predetermined dimensioning, will engage when 30 is pivoted by spring 67 the maximum distance desired. Plate 63 and cap 42 are then clamped against the top and bottom of the ring by any means such as screws or bolts 65 such as shown in FIG. 17A.

In the operation of the present device, particularly where there is no access slot 48, the bore 20 of head 10 is aligned with the nose of the workpiece shaft, nut or pipe. The outer or side surfaces 76 (See FIG. 2) of the jaw members are then gently brought into contact with the nose of the workpiece. The head is then slowly rotated about its axis in a direction, i.e., clockwise in FIG. 2, to drag and pivot the face ends of the members toward their neutral contact portions 38 whereby continued slight axial pressure on the head toward the workpiece eventually slips the head onto the workpiece. Then, by reversing rotation of the head, the gripping faces will ramp up toward their working contact portions 40 and tighten their grip on the workpiece.

The invention has been described in detail with particular reference to preferred embodiments thereof, but it will be understood that variations and modifications will be effected with the spirit and scope of the invention.

I claim:

1. Wrench structure comprising a drive head having a generally disc-shaped body means formed to provide a base side and an access side, substantially circular bore means formed around a rotational axis thru said body means for accommodating a substantially circular workpiece and being defined by inner peripheral wall means, a plurality of recesses formed into said access side in a substantially circular pattern around said rotational axis and opening generally radially into said bore means, each said recess being provided with a first pivot means for a gripping jaw member and providing a pivot axis therefor, all said pivot axes being positioned substantially equidistantly from said rotational axis, a plurality of gripping jaw members each having a longitudinal axis and a second pivot means for cooperating with said first pivot means for pivotally mounting said jaw members on said first pivot means, each said jaw member having a gripping face oriented generally toward said rotational axis and having at least a portion of said face extending into said bore means, each said jaw member having a pivot segment as measured along said longitudinal axis, each said gripping face being knurled and formed substantially on a radius line extending from an arc centerpoint on said radius line and making an angle $\alpha$ of from about 6.0° to about 25° with said longitudinal axis at a lateral midpoint of said face, said face having a variable length neutral contact portion and a variable length working contact portion, and cap means on said access side of said body means and covering top portions of said recesses and of said jaw members.

2. The structure of claim 1 wherein access slot means is formed generally radially thru an edge portion of each said body means and cap means and enters into said bore means for allowing said drive head to be laterally moved on over said workpiece.

3. The structure of claim 1 wherein said first and second pivot means comprise dowels which are frictionally pressed into apertures thru said base side and said cap means and holding said body means, jaw members and cap means in an assembled condition without the need for screws or the like.

4. The structure of claim 1 wherein spring means are provided in said recesses to bias the jaw members toward their gripping positions.

5. The structure of claim 1 wherein first shoulder means are provided on a radially outer portion of each said jaw member, and a hand operable, generally sleeve-shaped actuator means is rotatably mounted on said body means radially outwardly of said recesses and is provided with second shoulder means engageable with said first shoulder means upon rotation of said actuator means to thereby selectively pivot said jaw members toward or away from engagement with a workpiece positioned in said bore means.

6. The structure of claim 1 wherein the ratio of the length of said radius line to the length of said pivot segment, as measured in the same units, preferably ranges from about 2 to about 7, and most preferably from about 2.5 to about 3.5.

7. The structure of claim 1 wherein said inner peripheral wall has a diameter of from about 2.5 to about 3.5 inches across said rotational axis, each said radius line length is from about 1.5 to about 1.55 inches including knurl height on each gripping face, each angle $\alpha$ is from about 10.0° to about 13.0° each pivot segment length is from about 0.4 to about 0.8 inches excluding the knurl height, the total width of each gripping face is from about 0.3 to about 0.8 inches, the maximum radial translation of each face is about 0.1 inches, and each knurl height is from about 0.01 to about 0.015 inches.

8. The structure of claim 2 wherein the knurl has a spike density of from about 350 to about 560 spikes per square inches of gripping face, and a spike height of from about 0.01 to about 0.015 in.

9. The structure of claim 5 wherein spring means is provided on said body means and in engagement with said jaw members to bias said members toward engagement with a workpiece positioned in said bore means.

10. The structure of claim 1 wherein said body means is provided with a radially outwardly extending torque adapter prominence having a key element thereon for receiving a mating key element of a crank arm.

11. The structure of claim 10 wherein said key element of said crank arm has a torque axis which is coextensive with said rotational axis of said bore means.

12. The structure of claim 11 in combination with a torque wrench having a key element adapted to be placed in torqueing engagement with said key element on said crank arm.

13. The structure of claim 1 wherein peripheral portions of said body means and said cap means are formed with cooperating shoulder means to provide a nesting configuration to the joint between said body means and cap means and thereby markedly increasing the lateral strength of the joint.

14. The structure of claim 1 wherein each said jaw member is a monolithic structure provided on its upper portion with a first stub shaft and on it lower portion with a second stub shaft, each stub shaft being oriented on said pivot axis, and wherein said first stub shaft is pivotally mounted in bearing means in said body means and said second stub shaft is pivotally mounted in bearing means in said cap means.

15. The structure of claim 1 wherein each said jaw member is a monolithic structure having a forward end and a rearward end and formed with a quasi shaft segment on its rearward end and a gripping face on its forward end, said quasi shaft segment having a pivot axis, said body means comprising a disc shaped base member having a substantially centrally positioned bore and a substantially planar upper surface, and a ring member positioned on the outer peripheral portion of said base member and having an inner, substantially circular ring surface oriented substantially normally to the plane of said upper surface, and a plurality of bearing recesses formed into said ring member each on a bearing axis oriented substantially normal to said upper surface and opening toward said bore thru a pivot channel in said ring surface, each said quasi shaft segment being pivotally mounted in a said bearing recess with said bearing axis being coextensive with said pivot axis, and with said forward gripping face extending at least partially into said bore in a lateral direction with respect to the rotational axis of said bore.

16. Wrench structure for placement on over a generally circular workpiece in either a lateral or an axial direction, said structure having a drive head with a cavity formed by a base means and an access cap means, a bore formed thru said base means and cap means around a rotational axis of said bore for accommodating said workpiece, a plurality of gripping jaws pivotally mounted within said cavity and arranged in a substantially circular pattern around said rotational axis and having gripping faces extending at least partially into said bore, and spring means on said drive head engaging said jaws and urging them in a direction whereby said faces are maintained at least partially within said bore, each said face being knurled and formed substantially on a radius line which makes an angle from about 6.0° to about 25° with a longitudinal axis of the jaw at a midpoint of the face, whereby each face has a neutral contact portion and a working contact portion.

17. The structure of claim 16 wherein each said jaw member is a monolithic structure provided on its upper portion with a first stub shaft and on it lower portion with a second stub shaft, each stub shaft being oriented on said pivot axis, and wherein said first stub shaft is pivotally mounted in bearing means in said base means and said second stub shaft is pivotally mounted in bearing means in said cap means.

18. The structure of claim 16 wherein each said jaw member is a monolithic structure having a forward end and a rearward end and formed with a quasi shaft segment on its rearward end and a gripping face on its forward end, said quasi shaft segment having a pivot axis, said base means comprising a disc shaped base member having a substantially centrally positioned bore and a substantially planar upper surface, and a ring member positioned on the outer peripheral portion of said base means and having an inner, substantially circular ring surface oriented substantially normally to the plane of said upper surface, and a plurality of bearing recesses formed into said ring member each on a bearing axis oriented substantially normal to said upper surface and opening toward said bore thru a pivot channel in said ring surface, each said quasi shaft segment being pivotally mounted in a said bearing recess with said bearing axis being coextensive with said pivot axis and with said forward gripping face extending at least partially into said bore in a lateral direction with respect to the rotational axis of said bore.

* * * * *